United States Patent [19]

Frater

[11] Patent Number: 4,788,914

[45] Date of Patent: Dec. 6, 1988

[54] MISSILE NOSEPIECE

[75] Inventor: James T. Frater, Fairlawn, Ohio

[73] Assignee: Loral Corporation, New York, N.Y.

[21] Appl. No.: 153,110

[22] Filed: Feb. 8, 1988

[51] Int. Cl.[4] ..... F42B 15/22; F42B 17/00

[52] U.S. Cl. ..... 102/399; 102/293; 102/390

[58] Field of Search ..... 102/293, 390, 399; 114/20.1, 22

[56] References Cited

U.S. PATENT DOCUMENTS

| | | | |
|---|---|---|---|
| 2,889,772 | 6/1959 | Howard | 102/390 |
| 3,110,262 | 11/1963 | West | 102/399 |
| 3,279,405 | 10/1966 | Billmeyer | 102/390 |
| 3,477,376 | 11/1969 | Nelson et al. | 102/399 |

*Primary Examiner*—Charles T. Jordan

*Attorney, Agent, or Firm*—P. E. Milliken; L. A. Germain

[57] ABSTRACT

A nosepiece for the forward end of a missile that is launched into the atmosphere for a ballistic trajectory and a water entry impact comprises a frangible base and a separable nosecap, the base having multiple segments of rigid foam defining an axial bore into the base and a volume of soft cellular foam within the bore to protect the forward end of the missile. The nosecap is in seated relationship within the bore opening on the tip end of the base during airborne flight and separates therefrom to expose the axial bore opening prior to water entry impact such that upon impact the base is fractured by the force of water entering the exposed bore and thus separated from the missile.

16 Claims, 3 Drawing Sheets

MISSILE NOSEPIECE

This invention was made with Government support under Contract No. NO0024-84-C-6107 awarded by the Department of the Navy. The Government has certain rights in this invention.

BACKGROUND OF THE INVENTION

This invention generally pertains to missile nosepieces and more particularly to a nosepiece for a missile of a type which includes a homing torpedo as a primary element of its configuration. The missile is fired from a launching canister and is airborne for a portion of its mission to an underwater target whereupon it enters the water environment such that the torpedo may search out and destroy the target.

It is an important consideration in this type of missile application that the acoustic homing mechanism located in the forward end of the torpedo be protected from damage throughout the mission environment, i.e., at launch from the canister, during airborne flight to the target area, and upon entry into the water. Damage to the homing mechanism during any portion of the mission will obviously result in defeat of the torpedo performance. Further, it is important to the success of the missile that the nosepiece provide aerodynamic stability when it is airborne while also being of a construction which enables it to be separated from the torpedo portion of the missile upon entry into the water such that no portions of the nosepiece interfere with the homing mechanism and/or its operation.

SUMMARY OF THE INVENTION

This invention provides a nosepiece for the forward end of a missile that is launched into the atmosphere for a ballistic trajectory and a water entry impact comprising in combination:

a frangible, ogive-shaped base having a forward tip end and a rearward base end, the base end adapted for mounting to the forward end of the missile and the tip and truncated to expose an axial bore opening into the base;

at least two segments of a rigid, cellular foam within the interior of the ogive-shaped base and defining an axial extension of the bore opening for a substantial portion of the length of the base from the tip end to the base end;

a volume of a soft, open-celled foam within the axial bore; and a nosecap adapted to fit into the bore opening at the forward tip end of the base and having an exterior surface shape which is an extension of the ogive-shaped base, said nosecap being in a seated relationship on the tip end of the base during airborne flight of the missile and separable therefrom to expose the axial bore opening prior to water entry impact such that upon impact the ogive-shaped base is fractured by the force of water entering the exposed axial bore opening and is thus separated from the missile to completely expose the forward end of the missile.

BRIEF DESCRIPTION OF THE DRAWINGS

For a complete understanding of the invention, reference should be made to the following detailed decription and the accompanying drawings, in the several figures in which like-reference numerals indicate like elements and wherein.

DETAILED DESCRIPTION OF THE INVENTION

Figure 1:
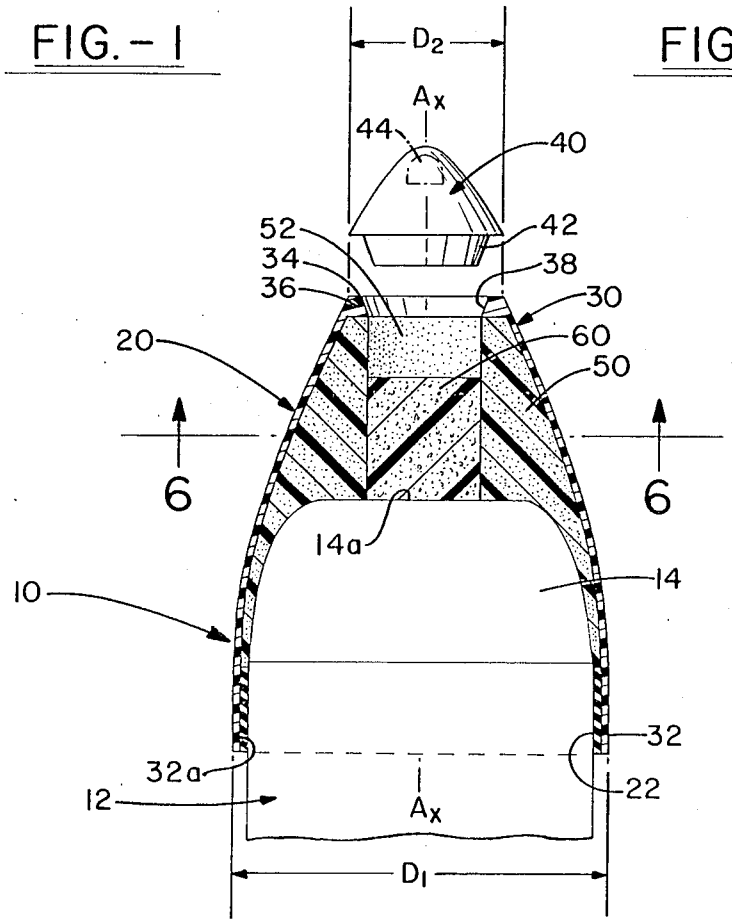
FIG. 1 is an elevational view, partially broken away and in cross-section, of the forward end of a missile showing the elements of an attached nosepiece in accordance with the present invention.

Referring to the drawings, FIG. 1 is an elevational view of the forward end of a missile generally indicated by reference numeral 10. The missile 10, while also including a propulsion means at the rearward end (not shown in the drawing), is primarily in a configuration of a torpedo indicated generally by reference numeral 12. The torpedo 12 is characterized by an acoustic homing mechanism 14 which is conventionally positioned at, and mounted to, the forward end. In its pre-launch condition, the missile 10 is stowed in a canister 16 (shown in FIG. 2) which includes a closure 18 at the open exit end 16*a*. The canister 16 is configured to function as the launch tube for the missile 10 when it is fired into the atmosphere. A nosepiece, generally indicated by reference numeral 20 provides an aerodynamic forward shape to the missile and this is necessary for the airborne portion of its mission. The nosepiece, however, must be removed for the balance of the mission when the torpedo enters the water and functions to search out and destroy a target in the water. In accordance with this invention, the nosepiece 20 is designed to function aerodynamically for airborne flight while being capable of separation from the torpedo 12 when it enters the water environment and this, without impeding the function of the homing mechanism 14. According to this invention, the nosepiece 20 comprises a substantially trancated, ogive-shaped base portion 30 and a separable nosecap portion 40.

The ogive-shaped base portion 30 is characterized by a rearwardly-directed base end 32 having a diameter D1 and a forward-directed tip end 34 having a diameter D2. The rearwardly-directed base end 32 is mated to the forward end of the torpedo 12 and this may be accomplished by various techniques. A particular one technique comprises mounting a seal ring 22 within the base openign 32*a* such that when it is slipped onto the torpedo 12, a close interference fit results. The seal ring 22 may be made of various type materials and in various configurations such that the base 30 is easily moved onto and mounted to the torpedo 12, but it cannot be easily moved in the opposite direction, i.e., removed. A particular seal ring 22 may be comprised of an elastomeric or suitable plastic material and such type seal rings are, of course, already known in various of the arts. The base portion 30 comprises, but is not limited to, a fiber-impregnated composite molded to a 1.25 Von Karman ogive-shape. Other known ogive shapes may obviously be applied to this application and various composite materials will meet the needs of the invention. For example, a chopped fiberglass-impregnated resin composite provides a suitable and sufficiently strong nosepiece base 30 capable of withstanding the compressive axial loads encountered by the missile during its operation while also being capable of destruction when the load forces are tensile and exceed a particular threshold value. In this respect, the threshold force may be designed into the structure and the nosepiece may thus operate within a particular and predetermined force window which matches the mission environment. Molding techniques to accomplish this are known and considered to be within the skill of those persons working and knowledgeable in this art. In any event, the tip end 34 may be molded with a reinforcement ring 36 which defines a bore opening 38. The bore opening 38 is axial with respect to the central axis Ax—Ax of the nosepiece 20 and its purpose includes mounting of the nosecap 40 therein in a particular seated relationship.

Figure 5:
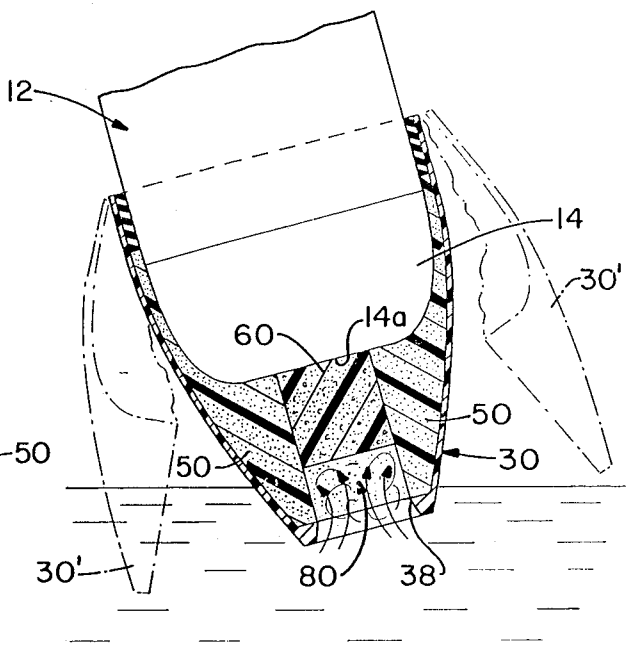
FIG. 5 is an elevational view, partially broken away and in cross-section, of the missile shown in FIG. 4 illustrating separation of the nosepiece elements upon water impact.
Figure 6:
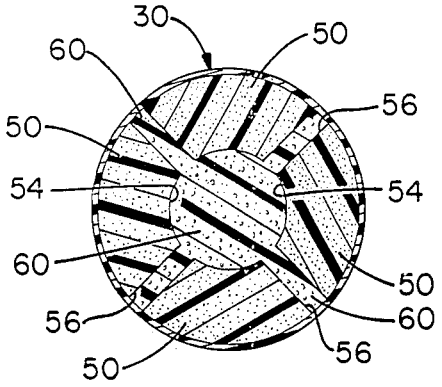
FIG. 6 is a cross-sectional view through the nosepiece as may be taken on line 6—6 of FIG. 1.

Referring now also to FIG. 6 of the drawings, the ogive-shaped base 30 includes a substantial volume of foam material within its interior space, the foam material being indicated at reference numerals 50 and 60. The foam material 50 comprises at least two but preferably multiple segments and/or quadrants of a rigid polyurethane foam. These may be integrally molded into the interior volume space as shown and offer additional support to the base 30 when it is subjected to axial compressive loads. The foam segments 50 substantially define an axial bore 52 which is an extension of the bore opening 38 as indicated by the arc segments 54 in FIG. 6. The foam material 60 substantially fills the axial bore 52 and it comprises a soft, open-celled foam that protects the frontal surface area 14*a* of the acoustic homing mechanism 14. The soft cellular foam 60 may also extend radially into spaces 56 which are provided between the rigid foam segments 50 as shown in FIG. 6. The circumferentially-spaced segments 50 and spaces 56 enhance the fracturability of the base 30 and this will be better understood and appreciated with regard to the description of FIG. 5 to follow hereinafter.

The nosecap 40 completes the nosepiece 20 and it is a solid piece, preferably of a metal construction, which may be machined to a shape which is an extension of the outside surface contours of the ogive-shaped base 30 when it is in a seated relationship within the bore opening 38. For example, it is a necessary requirement for aerodynamic stability during airborne flight of the missile 10 that the surface interface between the ogive-shaped base 30 and the nosecap 40 be as smooth as possible. This may be accomplished by a nosecap 40 that is precisely machined to match the diameter D2 at the tip and 34 and therefore presents an ogive-shaped extension of the base 30. The nosecap 40 also has a machined base end 42 that fits the bore opening 38 in the base portion 30 such that seating of the base 42 into the bore opening 38 results in a match-up of the outside surface contours of both the base 30 and nosecap 40. This may be accomplished by providing matching tapers within the bore 38 and about the base end 42 as illustrated in the drawings. A solid forged aluminum nosecap 40 may be precisely machined to meet the needs of the invention and further presents a substantially weighted piece that will meet the operational requirements to be described herinafter. Further, additional weight indicated by ghost lines at 44 may be inserted into the forward end of the nosecap 40 such as to give it a weight-forward concentration in a freefall condition for increased aerodynamic stability. The importance of this will be appreciated with the description of FIG. 4 to follow.

Figure 2:
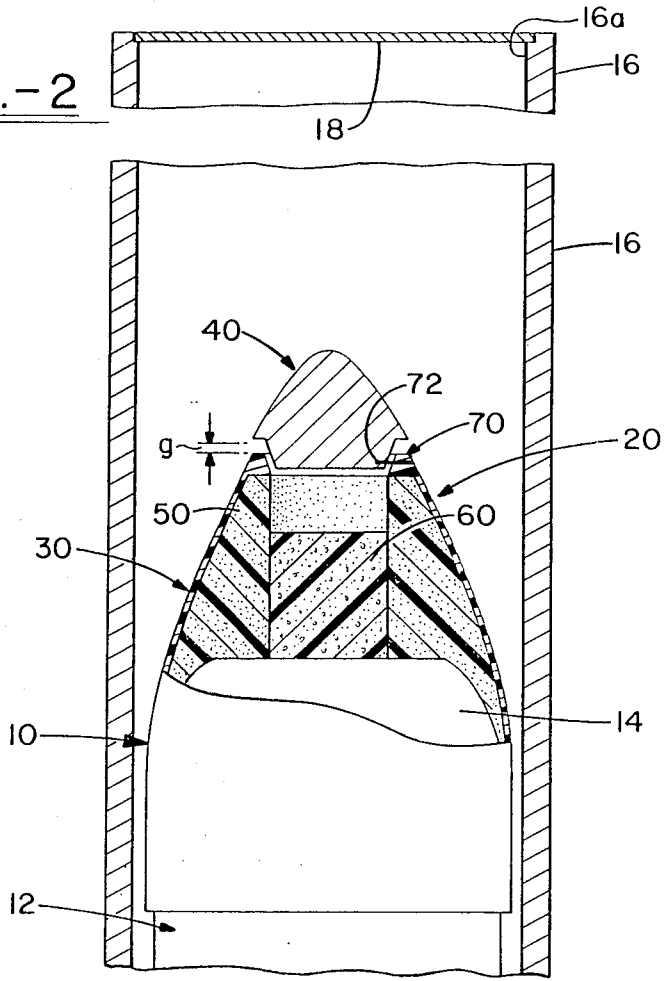
FIG. 2 is an elevational view, partially broken away and in cross-section, of the missile shown in FIG. 1 illustrating a first condition of the attached nosepiece prior to its being launched from a storage canister.
Figure 3:
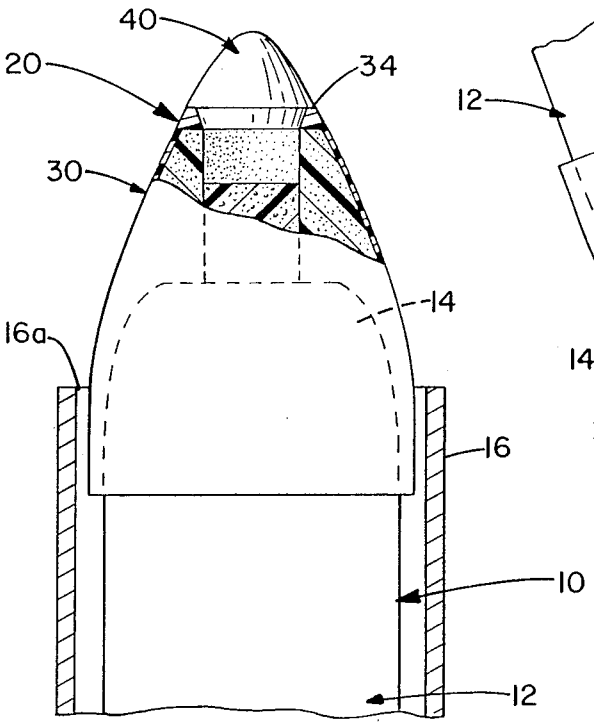
FIG. 3 is an elevational view, partially broken away and in cross-section, of the missiel shown in FIG. 2 illustrating a second condition of the attached nosepiece at the time the missile is launched and exits the canister.

Referring to FIGS. 2–5 of the drawings, a missile 10 is illustrated in FIG. 2 as it may be housed in a launch tube and/or canister 16. The canister 16 includes an end closure 18 which is adapted to be "broken-through" as the missile 10 leaves the canister at launch. As hereinbefore described, the missile 10 comprises a torpedo 12 having a homing mechanism 14 and a nosepiece 20 which functions to protect the homing mechanism. The nosepiece 20 which comprises this invention includes an ogive-shaped base 30 and a nosecap 40, the nosecap 40 being separable from the base 30. In accordance with one embodiment of the invention, the nosecap 40 is mounted to the base 30 in an axially spaced-apart position, the space between the two being indicated at "g" in the drawing. The nosecap 40 is maintained in the axial spaced position by reason of a fastening means 70 which may comprise any suitable fastener meeting the needs of the invention. For example, the fastening means 70 illustrated in FIG. 2 comprises a plurality of shear pins 72 which are mounted to pass radially through the reinforcement ring 36 and into the base 42 of the nosecap 40. The shear pins 72 hold the nosecap 40 to the ogive-shaped base 30 during normal handling of the missile 10 but are chosen to exhibit failure at a predetermined axial force on the nosecap. When this happens, the nosecap 40 is pushed into the bore 38 and thus seated in the tip portion 34 of the base 30. FIG. 3 of the drawings illustrates this condition wherein the missile 10 is shown just after it is propelled through the canister closure means 18. Break-through of the missile through the closure means 18 exerts sufficient axial compressive loading on the nosecap 40 to cause failure of the shear pins 72 and this results in the nosecap being axially seated on the tip portion 34 of the base 30. In this condition, the missile exhibits an aerodynamic forward front for airborne flight through the atmosphere.

Figure 4:
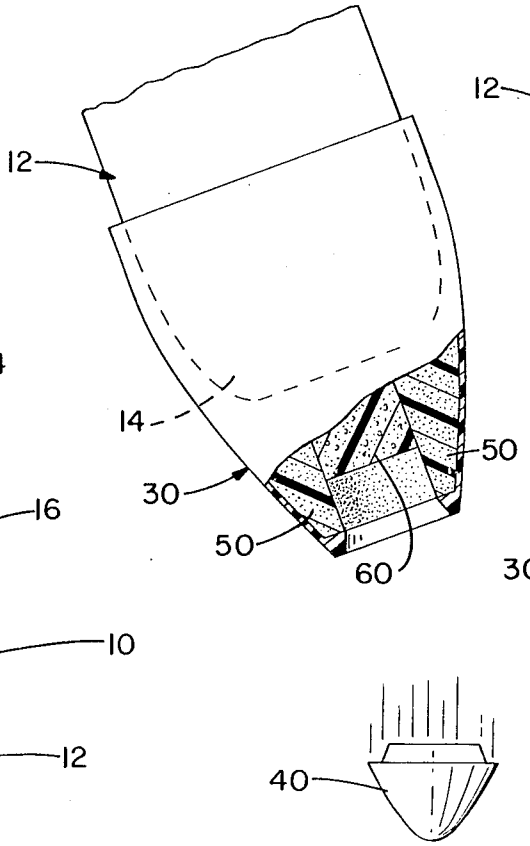
FIG. 4 is an elevational view, partially broken away and in cross-section, of the missiel shown in FIG. 3 illustrating a third condition of the nosepiece upon completing a ballistic flight path and deploying a retarding device and just prior to water entry impact.

As hereinbefore stated, the missile 10 is propelled out of the launch tube 16 and thereafter continues on a ballistic trajectory to the target area. Upon completion of the ballistic trajectory, a retarding device, such as a parachute or the like, is deployed to slow down the missile as it approaches water entry. FIG. 4 of the drawings illustrates the condition of the nosepiece 20 when the retarding device (not shown) is deployed. At this instant the nosecap 40 falls away from the base 30 and, because of its weight and aerodynamic forward shape, it continues to fall at a faster velocity than the descending velocity of the retarded missile. FIG. 5 of the drawings illustrates the condition of the nosepiece at water impact. Because the nosecap 40 is gone, a slug of water 80 enters the bore opening 38 at the tip end 34 of the base 30 and the radial tensile forces which are present and directed on the interior walls of the base, fracture it and cause it to break away from the forward end of the missile. This is illustrated in the drawing by the ghost line showing of the base pieces indicated by reference numerals 30'. It will now be appreciated that the soft, cellular foam 60 provides necessary cushioning to protect the forward surface 14*a* of the homing mechanism 14 while the rigid foam segments 50 provide the necessary force transfer within the base 30 to break it away from the forward end of the torpedo 12. This happens almost instantly as it enters the water.

Figure 7:
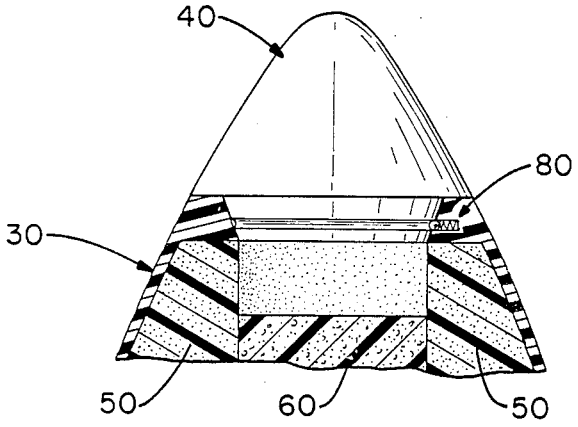
FIG. 7 is an enlarged elevational view, in partial cross-section, of the forward end of the nosepiece showing an alternative seating of the nosecap on the base.

From the foregoing description it will be recognized that if the ogive-shaped base 30 is designed to withstand greater axial forces, then it wouldn't be necessary that the nosecap 40 be mounted in a spaced position to accept the "break-through" forces at launch of the missile from the canister 16. In this circumstance, the nosecap 40 may be initially seated on the tip end 34 of the base 30 at launch. Prior to launch, the nosecap 40 may be held in the seated position within the bore 38 merely by a fastening means which would be sufficient to hold it in the bore during normal handling of the missile 10 but which would be insufficient to maintain it there when the retarding device is deployed at the end of the ballistic trajectory. For example, a ball-and-groove type fastening means 80 as shown in FIG. 7 may be employed to accomplish this. Upon being launched from the canister 16, the natural compressive "g" loads which are present and the ball-groove fastening means would hold the nosecap 40 to the base 30. When the retardation device is deployed, the attitude of the missile and the natural weight of the nosecap will overcome the fastening means 80 and allow it to move off the tip end 34 and fall freely away from the front end of the torpedo. The impact loads at water entry will still be sufficient to fracture and break up the base 30 such that it will be removed from the forward end of the torpedo 12.

While certain representative embodiments and details have been shown for the purpose of illustrating the invention, it will be apparent to those skilled in this art that various changes and/or modifications may be made thereto without departing from the spirit or scope of the invention.

What is claimed is:

1. A nosepiece for the forward end of a missile that is launched into the atmosphere for a ballistic trajectory and a water entry impact comprising in combination:

a frangible, ogive-shaped base having a forward tip end and a rearward base end, the base end adapted for mounting to the forward end of the missile and the tip end truncated to expose an axial bore opening into the base;

at least two segments of a rigid, cellular foam within the interior of the ogive-shaped base and defining an axial extension of the bore opening for a substantial portion of the length of the base from the tip end to the base end;

a volume of a soft, open-called foam within the axial bore; and a nosecap adapted to fit into the bore opening at the forward tip end of the base and having an exterior surface shape which is an extension of the ogive-shaped base, said nosecap being in seated relationship on the tip end of the base during airborne flight of the missile and separable therefrom to expose the axial bore opening prior to water entry impact such that upon impact the ogive-shaped base is fractured by the force of water entering the exposed axial bore opening and is thus separated from the missile to completely expose the forward end of the missile.

2. The nosepiece as set forth in claim 1 wherein the ogive-shaped base comprises a molded fiber-reinforced resin composite designed to accept axial loading on the nosepiece when the nosecap is seated on the base but is fracturable when the nosecap is removed and tensile radial forces are exerted outwardly from within the base.

3. The nosepiece as set forth in claim 1 wherein the nosecap comprises a solid metal piece machined to fit in a seated relationship on the base and provides an ogive-shaped extension of the base.

4. The nosepiece as set forth in claim 3 wherein the nosecap is mounted to the ogive-shaped base in an axial spaced-apart position by fastening means which hold the nosecap in position until the missile is launched, whereupon the nosecap is seated onto the base by the axial forces present at launch.

5. The nosepiece as set forth in claim 4 wherein the fastening means comprises a plurality of shear pins mounted through the tip end of the base and into the nosecap such that axial forces at launch fracture the shear pins and the nosecap is seated onto the ogive-shaped base.

6. The nosepiece as set forth in claim 3 wherein the base has a molded-in reinforcement at the tip end which defines an axial and tapered bore opening into the base and the nosecap has a machined matching taper for seating into the bore opening.

7. The nosepiece as set forth in claim 3 wherein the base comprises a fiberglass-impregnated resin composite.

8. The nosepiece as set forth in claim 3 wherein the nosecap is mounted to the ogive-shaped base in a seated relationship and held there by fastening means which may be overcome by the weight of the nosecap when the attitude of the missile is directed toward water entry impact.

9. The nosepiece as set forth in claim 1 wherein the ogive-shaped base includes a seal ring mounted within the rearward base end.

10. The nosepiece as set forth in claim 9 wherein the seal ring comprises an elastomeric material molded to a configuration which allows mounting of the nosepiece on the missile in an easy direction but which prevents removing of the nosepiece in the opposite direction.

11. The nosepiece as set forth in claim 1 wherein the nosecap includes an additional weighted mass positioned within the nosecap at its forward end.

12. The nosepiece as set forth in claim 1 wherein the rigid cellular foam segments are in spaced circumferential relative positions one to the other.

13. The nosepiece as set forth in claim 12 wherein the soft, open-called foam is also within the spaces between the circumferentially spaced-apart rigid foam segments.

14. The nosepiece as set forth in claim 2 wherein the base is shaped to a 1.25 Von Karman ogive.

15. The nosepiece as set forth in claim 3 wherein the nosecap comprises a machined forged aluminum.

16. The nosepiece as set forth in claim 13 wherein the rigid cellular foam segments comprise a polyurethane foam integrally molded into the interior of the base.

* * * * *